United States Patent [19]

Schossow

[11] 4,292,950

[45] Oct. 6, 1981

[54] GAS BURNER SYSTEM

[76] Inventor: George W. Schossow, 2316 Lilac La., White Bear Lake, Minn. 55110

[21] Appl. No.: 803,041

[22] Filed: Jun. 3, 1977

[51] Int. Cl.[3] ..... F23J 11/00; F24H 3/02

[52] U.S. Cl. ..... 126/110 A; 126/85 B; 126/112; 126/307 A

[58] Field of Search ..... 126/85 B, 110 A, 307 A, 126/112, 15 R, 77; 431/29, 72; 236/1 G

[56] References Cited

U.S. PATENT DOCUMENTS

| | | | |
|---|---|---|---|
| 105,393 | 7/1870 | Weston | 126/193 |
| 481,604 | 8/1892 | Wagner | 126/85 B |
| 1,289,321 | 12/1918 | Vest | 126/15 R |
| 1,752,663 | 4/1930 | Fagan | 126/85 B |
| 2,114,772 | 4/1938 | Althoff | 126/77 |
| 2,561,389 | 7/1951 | Machniak | 126/85 B |
| 2,734,501 | 2/1956 | Fauser, Jr. | 126/307 A |
| 2,937,697 | 5/1960 | Johnston | 236/1 G |
| 4,038,963 | 8/1977 | Dingwall | 126/85 B |
| 4,121,562 | 10/1978 | Grott | 126/85 B |

FOREIGN PATENT DOCUMENTS

| | | | |
|---|---|---|---|
| 2222259 | 10/1973 | Fed. Rep. of Germany | 431/72 |

*Primary Examiner*—Irwin C. Cohen

*Attorney, Agent, or Firm*—Merchant, Gould, Smith, Edell, Welter & Schmidt

[57] ABSTRACT

A gas burning furnace system is disclosed, including a blower which draws air from outside the home for combustion. The blower forces combustion air to the gas burner via a pressure box situated between the blower and the burner. The pressure box encloses a barrier having an adjustable aperture therein, through which the combustion air must pass before reaching the burner. By adjusting the size of the aperture, the rate of supply of combustion air to the burner can be regulated so as to produce complete fuel combustion without cooling the firebox.

3 Claims, 6 Drawing Figures

GAS BURNER SYSTEM

BACKGROUND OF THE INVENTION

Description of the Prior Art

In my copending application, Ser. No. 775,253, filed Mar. 7, 1977, now abandoned, I have disclosed a safe system for utilizing outside air for combustion in home heating plants. There are significant advantages in utilizing cold outside air to feed the flame during the heating season. Most present home heating plants draw air for combustion from inside the home, thus expelling heated air up the chimney stack, thereby creating a slight negative pressure within the home, with resultant drafts of cold, dry air which seep into the home under doors, around window casings, etc., to replace the lost warm air. My previously discussed invention provides means for supplying air exclusively from outside the home for combustion, while at the same time insuring that, if, for any reason, the outside air supply should fail, or become insufficient, the burner can draw air from inside the home in order to avoid suffocation of its flame. Suffocation of the flame, resulting in either incomplete fuel combustion, or total extinguishment of the flame, is especially dangerous in the case of furnaces utilizing natural gas as fuel (as opposed to fuel oil). Incomplete combustion of the gas results in the production of noxious carbon monoxide gas; total extinguishment of the flame could result in the introduction of a large quantity of the explosive fuel into a confined area of the home.

A gas burning home furnace system has not heretofore been known, which provides for the use of outside air for combustion, and includes safety provisions to insure complete combustion of the fuel and to eliminate the danger of extinguishment of the flame.

SUMMARY OF THE INVENTION

In accordance with the present invention, a gas burning furnace system is provided with means for supplying the burner with combustion air from outside the home. The supply means include a conduit which extends from an outside air vent, and is in fluid communication at its downstream end with a blower which forcefully draws outside air through the conduit.

The combustion air is forced through simple regulating means before passing to the burner unit of the furnace. The regulating means insure that the steady supply of cold air reaching the burners is sufficient to produce complete combustion of the fuel, but not too great, so as to lower the temperature of the firebox. The regulating means may comprise a barrier interposed in the combustion air path, having an adjustable aperture therein, through which the air must pass.

The furnace system of the present invention includes means for preventing any back drafts down the chimney stack from reaching the vicinity of the burner, where such drafts could extinguish the flame, and also includes safety means which will provide air from inside the home to the burners if the outside air supply should fail or otherwise become inadequate.

In further accordance with the present invention, the furnace system may include means for closing the outside air conduit after a brief time delay following shutoff of the furnace burner. This provision makes it possible to retain warm air in the firebox when the burners are shut off and the gaseous products of combustion have been allowed to clear the furnace. By placing the shut-off valve upstream of the firebox, the after draft up the chimney is eliminated without blocking an escape route should a potentially explosive situation occur in the firebox.

A draft corrector plate in the flue stack is also isolated from inside air, so that the stack draws outside air, rather than inside air when draft correction is required.

It will be appreciated from the foregoing summary that I have invented a gas burning furnace system having the advantages of being isolated from inside air and utilizing outside air for combustion, plus the availability of inside air as a safety precaution should the need arise.

DETAILED DESCRIPTION OF THE PREFERRED EMBODIMENT

Figure 1:
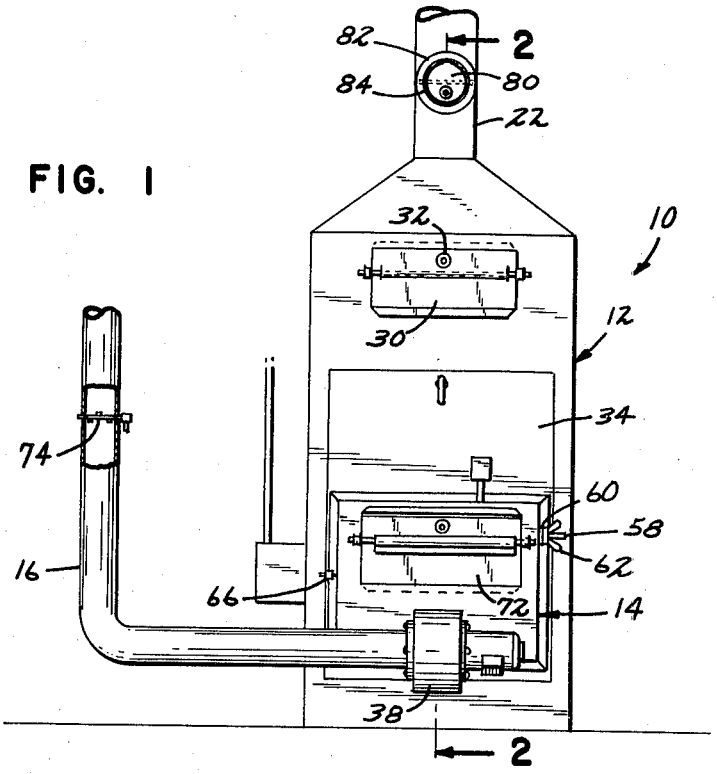
FIG. 1 is a view in end elevation with portions thereof broken away, of the furnace system of the present invention.
Figure 2:
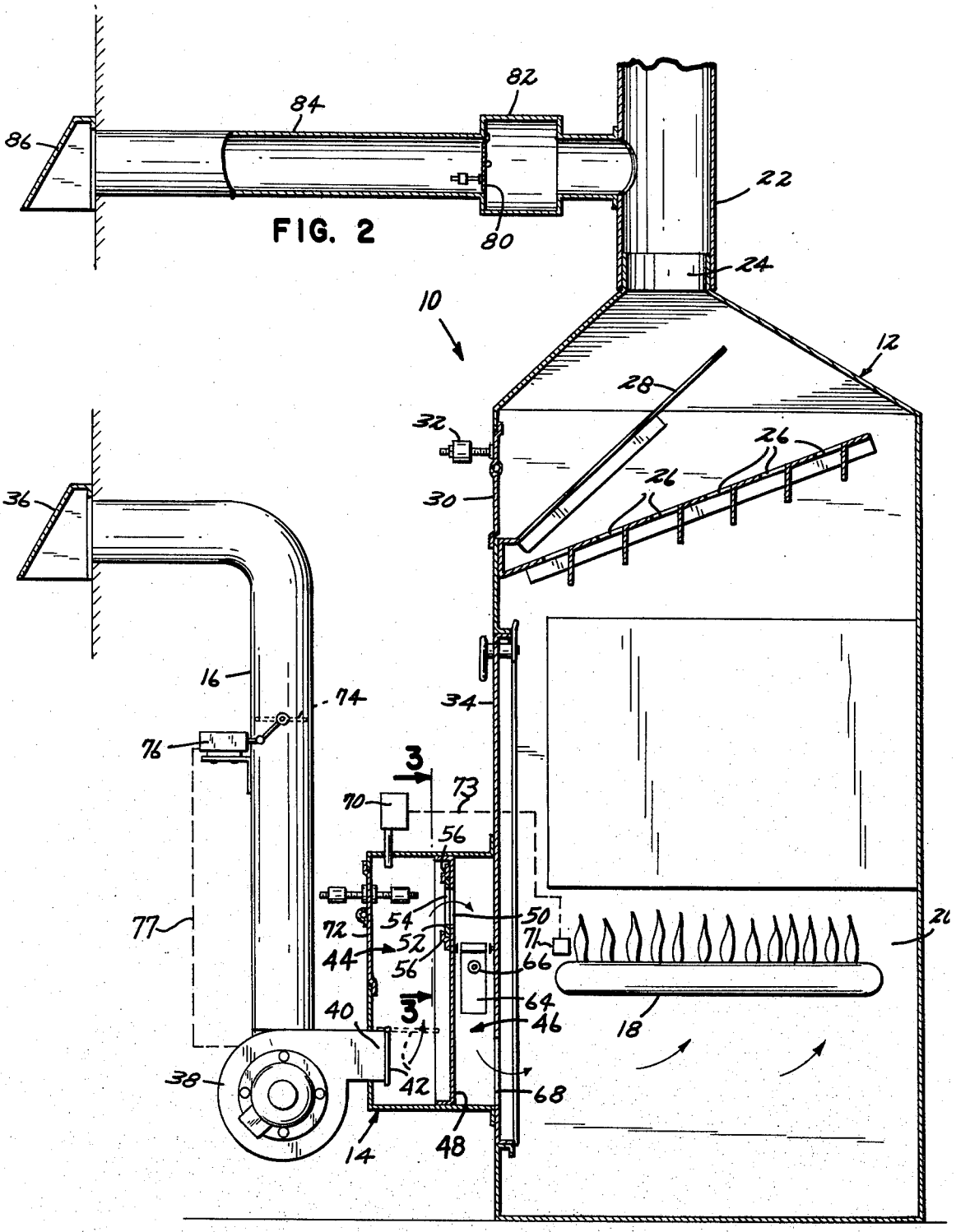
FIG. 2 is an enlarged sectional view taken generally along the line 2—2 of FIG. 1.

Referring first to FIG. 1, there is shown a gas burning furnace system 10, adapted for home use. System 10 would normally be located in the basement of a home and comprises the furnace 12, a pressure box 14, which encloses the burner intake of furnace 12, and outside combustion air duct 16. System 10 is shown in greater detail in FIG. 2. Referring to FIG. 2, furnace 12 encloses a burner unit 18 in firebox portion 20. Directly above firebox 20 is space in which a heat exchanger, return air plenum, etc., are generally located in a typical home furnace system. This apparatus has not been shown in the drawings for the sake of clarity.

A chimney stack 22 extends from the upper portion of furnace 12, to permit the exhaust of the gaseous products of combustion. Interposed between the chimney opening 24 and burner 18 are a plurality of baffles 26 and diverter plate 28. As is shown, diverter plate 28 extends deep enough into furnace 12 to underlie chimney opening 24. Thus, any back drafts down chimney 22 will be diverted towards a point on a front wall of furnace 12, at which point a barometric draft regulator plate 30 is pivotally mounted. Weight 32 is adjusted so that plate 30 normally hangs in a vertical, or closed, position. If a back draft is directed against the inside face of plate 30, the plate will swing open, venting the draft to the outside of furnace 12, and thus preventing such back drafts from extinguishing the flame in an ignited burner 18. Plate 30 will only swing open when backdrafts are present, and will not respond to negative pressure within the stack. Door 34 provides access to the interior of furnace 12.

Combustion air duct or conduit 16 extends from outside vent 36 at its upstream end, into blower 38 at its downstream end. The outlet 40 of blower 38 extends into pressure box 14 and is covered by swinging flap 42. When blower 38 is energized, it draws cold, outside air downward through duct 16, and forces this air into pressure box 14. The flow of air through blower 38 maintains flap 42 in the open position indicated by the dotted lines in FIG. 2.

Figure 3:
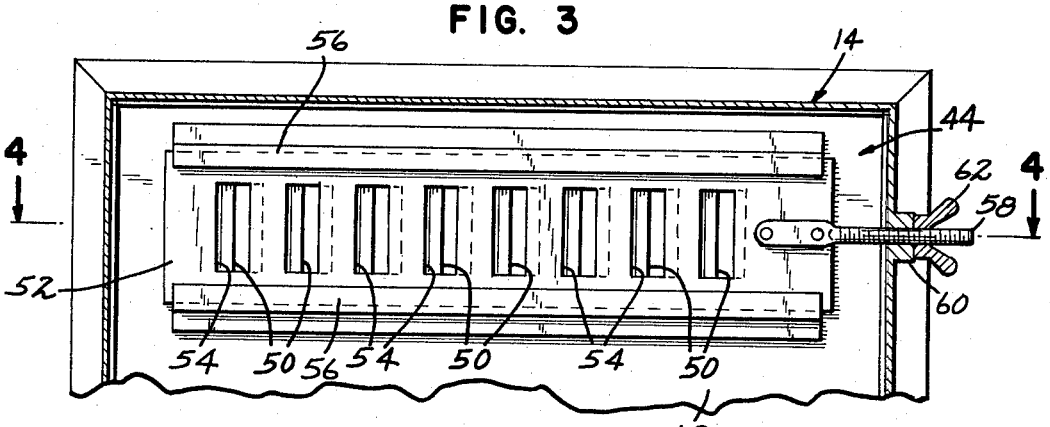
FIG. 3 is an enlarged sectional view taken generally along the line 3—3 of FIG. 2.
Figure 4:
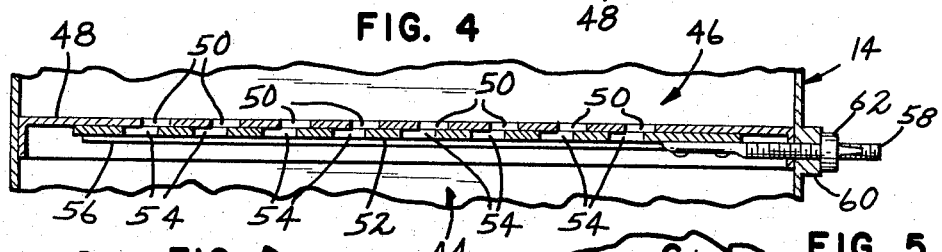
FIG. 4 is a sectional view taken generally along the line 4—4 of FIG. 3.

The interior of pressure box 14 is divided into an upstream chamber 44 and a downstream chamber 46 by baffle plate 48. The upper portion of baffle 48 is most clearly shown in FIGS. 3 and 4, from which it can be seen that baffle plate 48 contains a plurality of apertures 50, which are covered by grate 52, which has corresponding apertures 54 therein. Grate 52 is slidable in tracts 56, and can be moved so as to bring apertures 54 into register with apertures 50, allowing a maximum amount of combustion air to pass into downstream chamber 46, or can be moved so as to adjust the size of openings defined between the pairs of apertures, thus regulating the rate at which air passes into downstream chamber 46, and ultimately reaches burner 18.

In the embodiment shown, grate 52 is movable by means of threaded arm 58, which is fixed to grate 52 at one end, and extends through a collar and wing nut assembly 60 mounted on the outside of pressure box 14. By rotating wing nut 62, grate 52 may be slid back and forth across the face of baffle plate 48.

Figure 6:
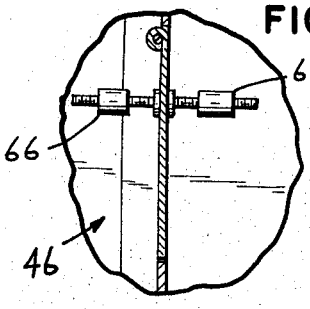
FIG. 6 is a sectional view taken generally along the line 6—6 of FIG. 5.
Figure 5:
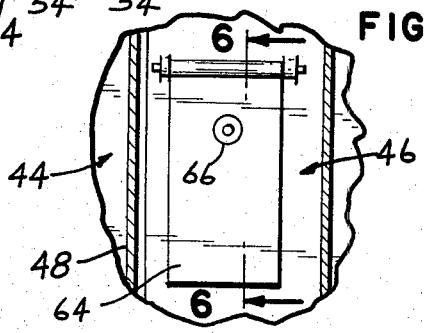
FIG. 5 is an enlarged elevational view of a portion of FIG. 2.

Mounted in an opening in exterior wall of downstream chamber 46 is a flapper plate 64. As is shown in FIGS. 5 and 6, plate 64 is pivotally mounted so as to swing freely, and carries a pair of adjustable, opposed, weights 66.

An ignited burner 18 requires oxygen at a certain rate to support a flame. If air is supplied to burner 18, via downstream outlet 68, at a lower rate than that which is required, the flame will suffocate, resulting in either incomplete combustion of the gas, or in complete extinguishment of the flame. If the rate of cold air supply is greater than that required, the temperature of the firebox will be lowered.

Cold air is supplied at a steady rate to upstream chamber 44 by blower 48. The rate at which this air enters downstream chamber 46 can be varied somewhat by adjusting the openings in baffle plate 48, as previously discussed. Flapper plate 64 acts as an indicator that the rate at which air enters chamber 44 is generally equal to the rate at which it is required by burner 18. To this end, weights 66 are preadjusted so that plate 64 will hang vertically in its opening when air is passing into and out of chamber 46 at the correct rate. The rate of inflow is then regulated by moving grate 52 as previously described. For example, if burner 18 is drawing air at a rate greater than that at which it is being supplied, plate 64 will swing inwardly. By increasing the size of the openings defined by baffle apertures 50 and grate apertures 56, until plate 64 hangs vertically, the proper rate of supply is obtained.

A pressure switch 70 is mounted in upstream chamber 44, and is operably connected with means well known in the art and shown diagrammatically as 71 for igniting burner 18. The connection between switch 70 and means 71 is illustrated diagramatically by dotted line 73 in FIG. 2. Switch 70 is biased so that burner 18 cannot be ignited until a predetermined pressure level has been obtained in chamber 44. A further safety precaution to avoid suffocation of the burner flame is weighted, barometric draft regulator plate 72, which is mounted in an opening in an exterior wall of upstream chamber 44 of pressure box 14. If the supply of combustion air should fail, for example, by blockage of vent 36, plate 72 would swing open in response to the vacuum created inside pressure box 14 by the steady air demand of the burner. This is a double fail-safe feature, since flapper plate 64 would also swing open in response to such a situation. Plate 72 could equally as well be mounted in a tee section of conduit installed in conduit 16, rather than in the wall of pressure box 14.

When thermostatic controls (not shown, but well known in the art) shut off burner 18 and blower 38, a draft of hot gases up chimney 22 continues. If not halted by some means, this after draft will continue until all heat has been drawn out of the firebox. While the after draft is necessary to some extent, so as to clear the furnace of potentially dangerous concentrations of exhaust gases, a continuous after draft is not required, and results in a wasteful heat loss. To cut off the after draft, a butterfly valve 74 is placed in conduit 16. Control means 76 open butterfly valve 74 when blower 38 is energized. When blower 38 is shut off, control means 76 close butterfly valve 74 following a predetermined time delay of sufficient length to allow the exhaust of combustion gases. The connection between control means 76 and the blower 38 is shown diagramatically by line dotted 77 in FIG. 2. When valve 74 is closed, the after draft up chimney 22 is halted.

To achieve the proper draft in chimney 22, a draft regulator 80 is mounted in tee section 82, which branches from chimney stack 22. Draft regulator 80 is adapted to provide cold air for draft regulation via conduit 84 and a second outside air vent 86. Since draft regulator, or corrector, 80 is vented to outside air, no heated home air may be drawn up chimney 22 to correct for overdraft, thus further preserving heated, humidified air within the home and decreasing any negative pressure within the home, either during burner operation or shut-off.

In operation, thermostatic control means energize blower 38, and send a signal via pressure switch 70 to ignite burner 18. As blower 38 is energized, control means 76 open butterfly valve 74, so that the cold combustion air is moved into upstream chamber 44 of pressure box 14. When a predetermined pressure is reached within chamber 44, switch 70 closes and burner 18 is ignited. The proper air supply rate may be manually regulated by moving grate 52 back and forth across apertures 50 in a baffle plate 48, as dictated by the movements of indicator flaps 64. When thermostatic controls shut off burner 18 and blower 38, control means 76 close butterfly valve 74 following a predetermined time delay of sufficient length to allow a brief after draft to clear furnace 12 of any residual combustion gases.

The above-described system is a safe, gas burning home furnace which utilizes outside air for combustion.

What is claimed is:

1. A gas burning furnace system comprising:

(a) a pressure box having downstream outlet providing fluid communication with a gas burner in a firebox, and an upstream inlet;

(b) a blower for pressurizing said pressure box with outside air, said blower having an inlet end and an outlet end in fluid communication with said upstream inlet end of said pressure box;

(c) a conduit extending from an outside air vent into said blower, whereby the blower draws air exclusively from outside the home and forces it into the pressure box;

(d) a baffle plate mounted within the pressure box between the pressure box inlet and outlet, dividing the interior of the pressure box into an upstream and a downstream chamber, said baffle plate having a plurality of apertures therein;

(e) a movable grate mounted on the baffle plate in superposed relationship to said plurality of apertures, whereby the grate may be moved to selectively adjust the size of the openings defined by the grate and the apertures;

(f) means extending outside the pressure box for moving the grate;

(g) a flapper plate pivotally mounted in an exterior wall of the downstream chamber of the pressure box, said flapper plate being adapted to swing in response to pressure changes within said downstream chamber;

(h) safety means for supplying air from inside the home to the burner, should the outside air supply become inadequate to satisfy the combustion air demands of the burner;

(i) means for preventing a back draft down a chimney from blowing out the burner flame, including at least one barometric draft regulator plate pivotally mounted in an exterior wall of the furnace and diverter means situated between the burner and the chimney for diverting any such drafts to said plate, whereby said plate may swing open to allow any such drafts to escape from the furnace before reaching the burner flame;

(j) means for preventing the ignition of the burner until a predetermined pressure has been reached within the pressure box, said ignition preventing means including a pressure sensitive switch mounted in said pressure box and operably connected with means for igniting the burner; and (k) a normally open butterfly valve mounted in the outside air conduit, and means for closing said valve after a time delay following shut-off of the burner.

2. The furnace system of claim 1 wherein said safety means comprise a barometric draft regulator plate pivotally mounted in an exterior wall of the upstream chamber of the pressure box.

3. A gas burning furnace system comprising:

(a) a gas burning furnace having an inlet aperture to a fire box and an outlet to an exhaust chimney;

(b) a pressure box surrounding said inlet aperture to said furnace, said pressure box having a downstream outlet providing fluid communication with the fire box of said burner and an upstream inlet;

(c) a motorized blower for pressurizing said pressure box with outside air, said blower having an inlet end and an outlet end in fluid communication with said upstream inlet of said pressurized box;

(d) a conduit extending from an outside air vent into the inlet end of said blower, whereby the blower draws air exclusively from outside the home and forces it into the pressure box;

(e) a baffle plate mounted within the pressure box between the pressure box inlet and outlet for dividing the interior of the pressure box into an upstream and a downstream chamber, said baffle plate having a plurality of apertures therein;

(f) a movable grate mounted on the baffle plate in superposed relationship to said plurality of apertures, whereby the grate may be moved to selectively adjust the size of the openings defined by the grate and the apertures to control the amount of air supplied to said fire box;

(g) a flapper plate pivotably mounted in an exterior wall of the downstream chamber of the pressure box, said flapper plate being adapted to swing in response to pressure changes within said downstream chamber, and means for adjusting said flapper plate to respond to different pressure changes;

(h) safety means comprising a barometric draft regulator plate pivotally mounted in an exterior wall of the upstream chamber of the pressure box for supplying air from inside the home to the burner if the outside air supply becomes inadequate to satisfy the combustion air demands of the burner;

(i) means for preventing a back draft down a chimney from blowing out the burner flame, including at least one barometric draft regulator plate pivotally mounted in an exterior wall of the furnace and a diverter plate situated between the burner and the chimney for diverting any such drafts to said draft regulator plate, whereby said draft regulator plate may swing open to allow any such drafts to escape from the furnace before reaching the burner flame;

(j) means for preventing the ignition of the burner until a predetermined pressure has been reached within the pressure box, said ignition preventing means including a pressure sensitive switch mounted in said pressure box and operably connected with means for igniting the burner;

(k) a normally open butterfly valve mounted in the outside air conduit, and means for closing said valve after a time delay following shut-off of the burner; and (l) a draft regulator conduit extending from the chimney to a second outside air vent for supplying outside air to said chimney to regulate the draft in said chimney.

* * * * *